US006076508A

United States Patent [19]

Nakano

[11] Patent Number: 6,076,508

[45] Date of Patent: Jun. 20, 2000

[54] FUEL INJECTION CONTROL DEVICE

[75] Inventor: Masahiko Nakano, Kanagawa, Japan

[73] Assignee: Isuzu Motors Limited, Tokyo, Japan

[21] Appl. No.: 09/116,996

[22] Filed: Jul. 17, 1998

[30] Foreign Application Priority Data

Jul. 22, 1997 [JP] Japan ..... 9-210161

[51] Int. Cl.[7] ..... F02D 41/40; F02M 51/06; F02M 47/02

[52] U.S. Cl. ..... 123/490; 361/154

[58] Field of Search ..... 123/490; 361/154; 251/129.15

[56] References Cited

U.S. PATENT DOCUMENTS

| | | | |
|---|---|---|---|
| 4,242,729 | 12/1980 | Weber et al. | 123/490 |
| 4,922,878 | 5/1990 | Shinogle et al. | 123/490 |
| 5,235,490 | 8/1993 | Frank et al. | 361/154 |
| 5,402,760 | 4/1995 | Takeuchi et al. | 123/300 |
| 5,592,921 | 1/1997 | Rehbichler | 123/490 |
| 5,794,586 | 8/1998 | Oda et al. | 123/305 |

FOREIGN PATENT DOCUMENTS

| | | |
|---|---|---|
| 826876 | 3/1998 | European Pat. Off. . |
| 3-000965 | 1/1991 | Japan . |
| 4-171266 | 6/1992 | Japan . |
| 10-077924 | 3/1998 | Japan . |

*Primary Examiner*—Tony M. Argenbright
*Assistant Examiner*—Arnold Castro
*Attorney, Agent, or Firm*—Browdy and Neimark

[57] ABSTRACT

During the low load operation, this fuel injection control device reduces the initial armature displacement speed of the solenoid actuator that drives the open-close valve against the low fuel pressure in the balance chamber, thereby lowering impact noise produced in the solenoid portions. When the engine is determined to be idling, a command pulse width which energizes the solenoids of the solenoid actuator is calculated according to the target injection amount, the common rail pressure, and the target fuel injection timing. Since the initial period of the command pulse width, i.e., pull-in current conduction period, is set shorter than the pull-in current conduction period for the high load operation of the engine, the initial armature displacement speed of the solenoid becomes relatively slow reducing the impact noise of the armature abutting against the stopper.

6 Claims, 6 Drawing Sheets

Injection amount — pulse width conversion map

FUEL INJECTION CONTROL DEVICE

BACKGROUND OF THE INVENTION

1. Field of the Invention

The present invention relates to a fuel injection control device applied to engines such as diesel engines and direct injection type gasoline engines.

2. Description of the Prior Art

A fuel injection control device for engines such as diesel engines has been known, in which an open-close valve provided in a fuel discharge passage for releasing fuel in a balance chamber is opened and closed by a solenoid actuator to control a pressure in the balance chamber and thereby control the lift of a needle valve that receives the fuel pressure in the balance chamber, optimumly controlling the amount of fuel to be injected and the injection timing according to the operating conditions of the engine, such as engine revolution and load.

The above fuel injection device has nozzle holes at the front end of the body for injecting fuel into the combustion chamber of the engine. A needle valve reciprocating in a hollow portion of the body opens and closes the nozzle holes with one end thereof. The fuel pressure in the balance chamber acts on the other end of the needle valve exposed in the balance chamber which forms a pressure receiving surface, to control the amount of lift of the needle valve (see Japanese Patent Laid-Open Nos. 965/1991 and 171266/1992 for example). The fuel pressure is supplied through supply passages into the balance chamber, whose pressure is released through the discharge passage. The open-close valve to open and close the discharge passage is driven by the solenoid actuator.

The applicant of this invention has proposed a fuel injection device with a control valve (Japanese Patent Laid-Open No. 77924/1998), in which the open-close valve installed in the discharge passage used to release the fuel in the balance chamber comprises a valve stem portion extending through the discharge passage into the balance chamber and a valve head portion provided at the front end of the valve stem portion and having a valve face that contacts a valve seat formed in the inlet side opening of the discharge passage to close the valve.

As to the control of fuel injection there is an increasing demand for increased fuel injection pressure to meet the requirements of emissions regulations, particularly the call for reduced amount of smoke.

During the idling where the amount of exhaust gases is relatively small, it is advantageous to lower the injection pressure for reduced vibrations and noise. An increased fuel injection pressure can disperse the injected fuel so that it can fully utilize not only the air present in the combustion chamber but the air in the cylinder bore as well, thus reducing the amount of smoke produced by incomplete combustion while at the same time meeting the conditions for high load operation. The high fuel injection pressure, however, increases the fuel injection rate causing sudden combustion, which in turn results in increased engine noise.

When the fuel injection pressure is reduced on the other hand, the low load operation can easily be dealt with. But during the high load operation that requires large fuel flows, the fuel injection period in one combustion cycle becomes longer, rendering the sprayed fuel not easily atomizable, deteriorating both the engine output and the exhaust gas characteristics.

Therefore, in a common rail pressure map that determines the common rail pressure, or fuel pressure in the common rail that stores fuel delivered from a fuel pump, it is common practice to set the fuel pressure high during the high load, high revolution operation and low during the low load, low revolution operation.

In a fuel injection device in which the valve head of the open-close valve in the form of a poppet valve is located on the chamber side, the open-close valve, when it is to be opened, needs to be pushed in toward the chamber side with a force stronger than the force produced by the fuel pressure in the chamber or the common rail-induced force. This drive force is required, because of the structure, to increase as the common rail pressure increases. Thus, the solenoid of the solenoid actuator is designed to produce a force enough to push in the open-close valve even when the common rail pressure reaches its maximum.

Designing the solenoid actuator in this way, however, results in driving the open-close valve with a large force provided for high common rail pressure even during the low load operation, such as idling, where the common rail pressure is set low. This produces injector noise, which consists mainly of impact noise between the control rod, which functions as the armature of the solenoid, and the stopper that restricts the displacement of the armature.

During the low load operation the pressure in the balance chamber is set low and the resistance against opening the open-close valve by the solenoid actuator is small. On the other hand, even when the attractive force of the solenoid is constant, the magnitude of the force is set large.

Hence, the initial armature displacement speed is high and the impact force of the armature striking the stopper is large. During the low load operation such as idling, in particular, because the combustion noise itself is small and there is no traveling noise that would be produced when running through the air and traveling on road, the impact noise between the armature and stopper can be very annoying.

SUMMARY OF THE INVENTION

An object of this invention is to solve the above problems and provide a fuel injection control device that, during a low load operation such as idling, performs a control to reduce the initial armature displacement speed of the solenoid actuator provided in the injector to reduce impact noise produced by the armature striking the stopper.

This invention relates to a fuel injection control device, which comprises: bodies having nozzle holes for injecting fuel into combustion chambers in an engine; needle valves reciprocating in hollow portions in the bodies to open and close the nozzle holes; balance chambers supplied a part of injection fuel to control the lift of the needle valves, an end of the needle valves forming fuel pressure receiving surfaces in the balance chamber; supply passages to supply a fuel pressure to the balance chambers; discharge passages to release the fuel pressure in the balance chambers; open-close valves to open and close the discharge passages; solenoid actuators to drive the open-close valves; sensors to detect the operating condition of the engine; and a controller to control drive current supply to the solenoid actuators according to the operating condition detected by the sensors; wherein the controller sets a pull-in current conduction period of the drive current supplied to the solenoid actuators when the operating condition detected by the sensors is a low load operation to a value shorter than a pull-in current conduction period of the drive current supplied to the solenoid actuators when the operating condition detected by the sensors is a high load operation.

The drive current supplied to the solenoid actuator has two distinct parts, a pull-in current and a hold current. The pull-in current is a current required to open the open-close valve provided in the form of a poppet valve; and the hold current is a current required to maintain the open-close valve in the open state after the valve has been opened. By controlling the pull-in current conduction period the initial armature displacement speed of the solenoid actuator can be controlled. When the operating state of the engine, as detected by sensors, is a low load operation, there is no need to set the injection fuel pressure high and thus the fuel pressure in the chamber into which a part of the injection fuel is introduced is relatively low. Thus, if the pull-in current conduction period of the drive current supplied to the solenoid actuator to open the open-close valve is set relatively short, the open-close valve can be opened easily. In other words, the initial armature displacement speed of the solenoid actuator that opens the open-close valve can be prevented from becoming too high, thus reducing the impact noise when the armature strikes the stopper.

The low load operation is an operation when the engine is idling. During idling, the vehicle is at rest not producing whizzing noise and the engine combustion noise itself is not large. Hence the impact noise produced by the solenoid actuator can be annoying. With this fuel injection control device, because, when the engine is in the idling state, the conduction period of the pull-in current supplied to the solenoid actuator to open the open-close valve is set relatively short, the impact noise of the solenoid actuator is lowered.

Further, the drive current conduction start timing for a low load operation is set earlier than the drive current conduction start timing for a high load operation, and the total conduction period of the drive current for a low load operation is set longer than that for a high load operation. When the open-close valve is open, the pressure in the balance chamber decreases, allowing the hold current required to maintain the open state of the valve to be set smaller than the pull-in current.

Setting the drive current conduction starts for a low load operation and for a high load operation at the same timing results in a delayed startup of the solenoid actuator operation and also a slow speed of the initial armature displacement because the hold current following the initial, short pull-in current is low. This will cause a delay in the opening of the open-close valve. As a result, although the speed of impact between the armature and the stopper can be reduced, the injection timing is delayed and the amount of fuel injected reduced.

To deal with this problem, the conduction start timing for a low load operation is set at a point before the conduction start timing for a high load operation and the total conduction period for a low load operation is set longer than that for a high load operation. This setting ensures an appropriate amount of injection fuel at an appropriate injection timing.

The solenoid actuator comprises: a solenoid portion including a solenoid and an armature driven by energizing the solenoid; a control rod drivingly coupled to the armature and moved to an operated position when the solenoid is energized to open the open-close valve; and a resetting means to reset the control rod to a non-operated position when the solenoid is deenergized to close the open-close valve.

With the solenoid actuator constructed as described above, energization of the solenoid of the solenoid portion causes the control rod to occupy the operated position against the force of the resetting means to open the open-close valve. Deenergizing the solenoid of the solenoid portion causes the resetting means to reset the control rod to the non-operated position to close the open-close valve.

The open-close valve comprises a valve stem extending into the discharge passage and drivingly coupled to the control rod; a valve head provided at the front end of the valve stem and having a valve face that can be seated on a valve seat formed in the opening of the discharge passage on the balance chamber side; and a return spring that urges the valve face to be seated on the valve seat.

The open-close valve of this construction, with the control rod assuming the non-operated position, has its valve face seated on the valve seat by the force of the return spring to close the valve; and the control rod, when moved to the operated position, urges the valve stem against the force of the return spring to part the valve face from the valve seat, thus opening the valve.

The injection fuel is supplied through the common rail that stores fuel delivered by the fuel pump. The fuel pressure in the common rail when the engine is operating at a low load is set lower than the fuel pressure in the common rail when the engine is operating at a high load. With this setting, the fuel injection pressure becomes high during the high load operation to disperse the fuel sufficiently to allow the use of even the air in the cylinder bore, reducing the amount of smoke due to incomplete combustion. During a low load operation, the fuel injection rate becomes small and the combustion moderate, reducing the engine noise.

The controller performs a control such that the pull-in current conduction period of the drive current supplied to the solenoid actuator to open the open-close valve when the operating condition as detected by sensors is a low load operation is shorter than the pull-in current conduction period of the drive current supplied to the solenoid actuator to open the open-close valve when the operating condition as detected by sensors is a high load operation. Hence, during a low load operation such as idling, the initial armature displacement speed of the solenoid actuator is lowered, which in turn reduces the impact force of the armature striking the stopper and therefore the engine noise in a low load operation.

DETAILED DESCRIPTION OF THE EMBODIMENT

An embodiment of this invention will be described by referring to the accompanying drawings.

Figure 1:
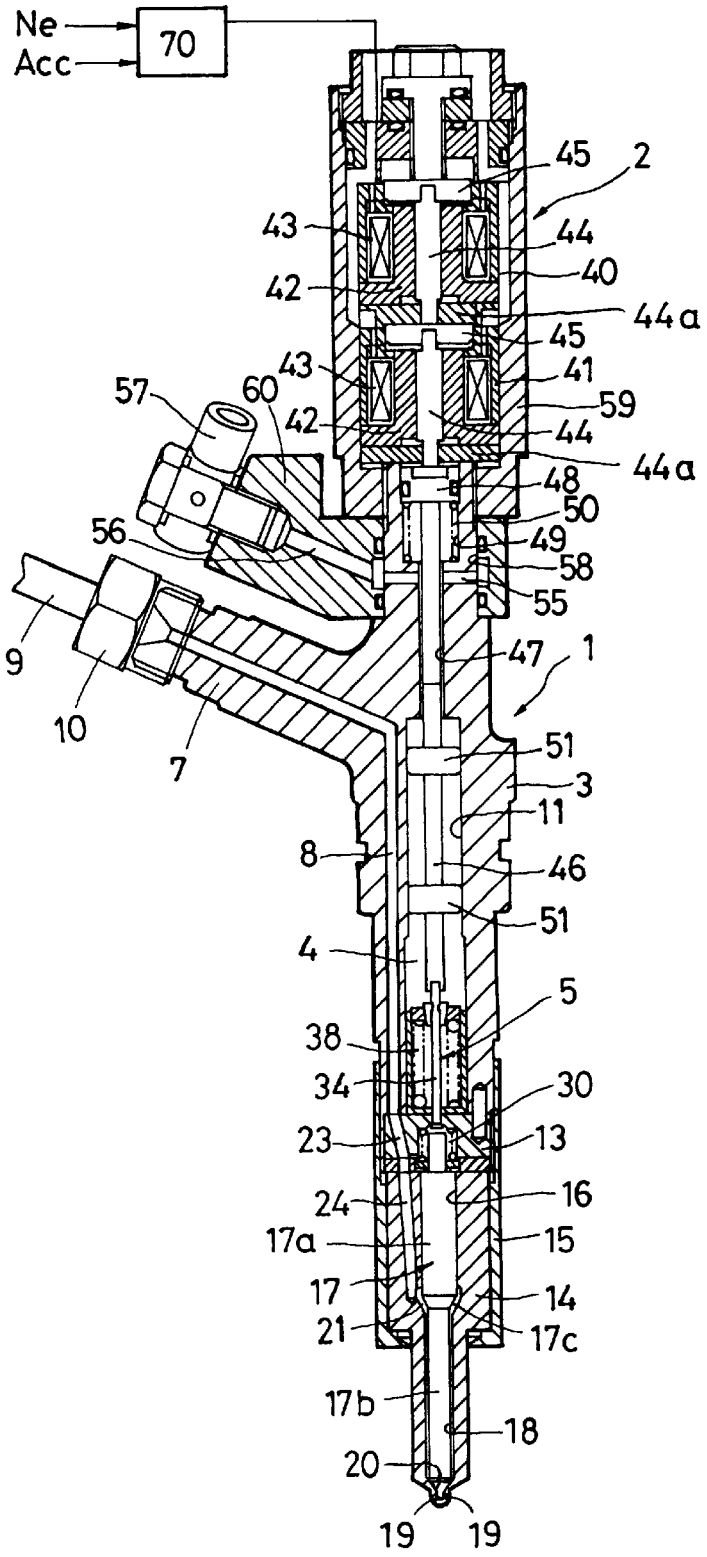
FIG. 1 is a cross section showing one example of an injector to which the fuel injection control device of this invention is applied.
Figure 2:
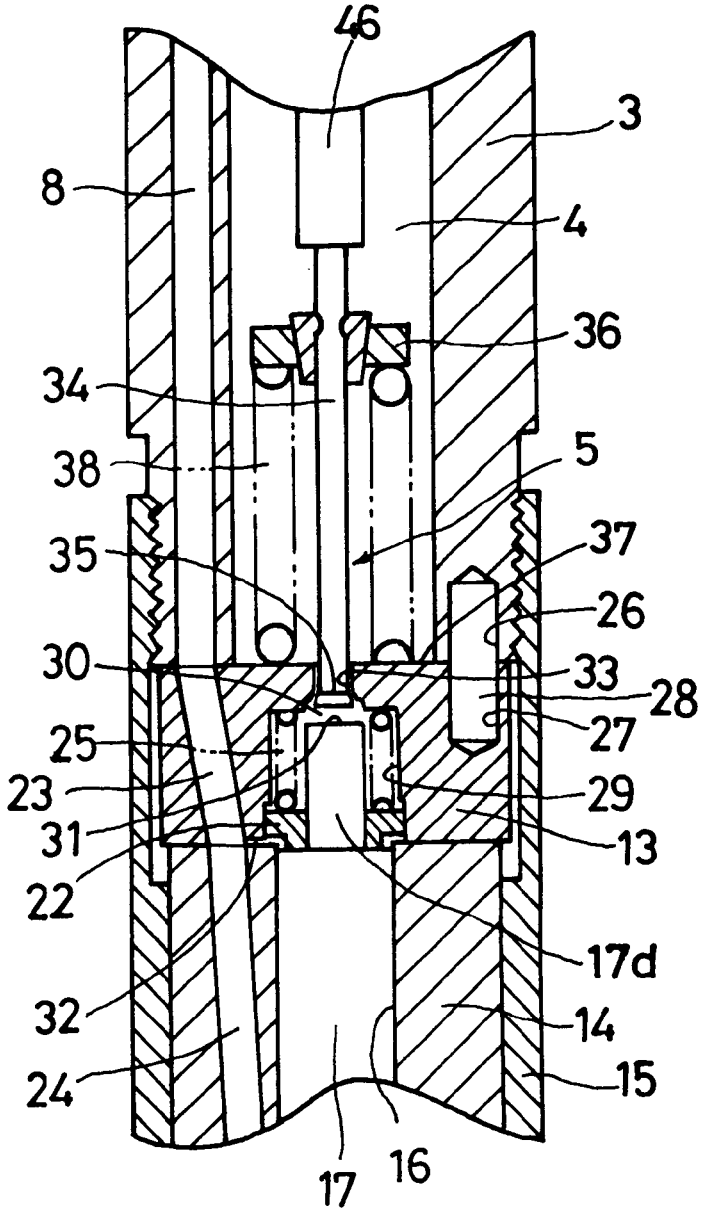
FIG. 2 is an enlarged cross section showing a part of the injector of FIG. 1 in an enlarged view.
Figure 3:
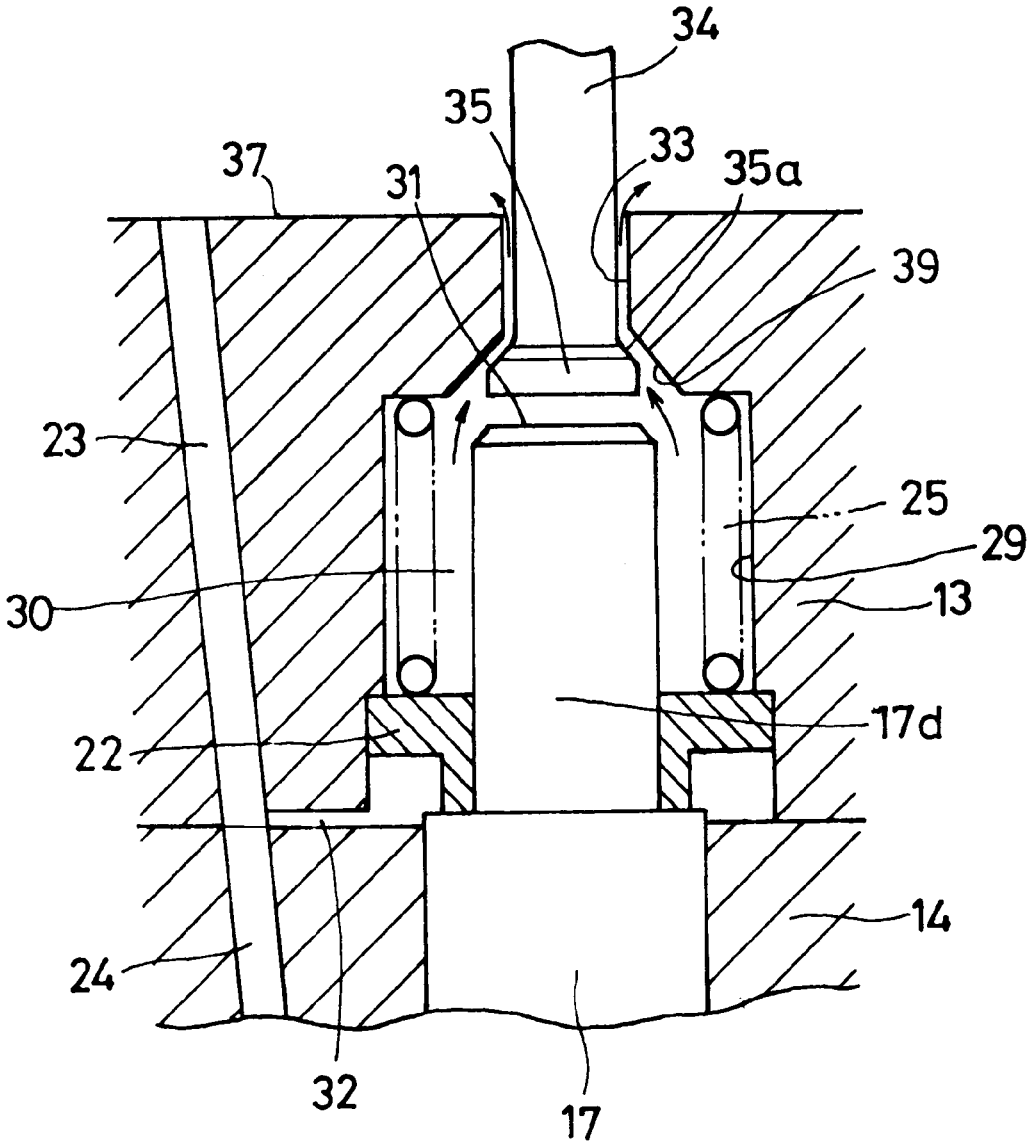
FIG. 3 is an enlarged cross section showing a part of the injector of FIG. 2 in a further enlarged view.

With reference to FIGS. 1, 2 and 3, one embodiment of an injector applying the fuel injection control device of this invention will be explained.

The injector is applied to a common rail injection system or an accumulator injection system (not shown). A high pressure fuel supplied through a common passage and a pressure accumulation chamber (not shown; hereinafter referred to as a "common rail") to which a fuel is supplied from a fuel injection pump is injected into individual combustion chambers in the engine by injectors. An injector body 1 has a solenoid actuator 2 provided on the base end side thereof to activate a needle valve 17 described later. The injector body 1 comprises a central portion 3 mounted to a bracket 60 as a fixing member such as an engine, a control portion 13, and a nozzle portion 14 that serves as a needle valve guide. The control portion 13 and the nozzle portion 14 are fixed to the central portion 3 by a threaded fixing cap 15.

In the central portion 3 is formed a longitudinally extending hollow portion 4 defined by a hole 11. In the hollow portion 4 is guided longitudinally slidably a control rod 46, described later, to activate the needle valve 17. A supply system for a high pressure fuel from the common rail ranges from a fuel supply pipe 9 to a fuel inlet portion 7 formed in the central portion 3 and having the fuel supply pipe 9 connected thereto with a connection fitting 10, to a fuel supply passage 8 formed in the central portion 3, to a fuel supply passage 23 formed in the control portion 13, to a fuel supply passage 24 formed in the nozzle portion 14 and to a fuel retaining portion 21 formed around a tapered surface 17*c* of the needle valve 17.

In the front end portion of the injector body 1, i.e., the control portion 13 and the nozzle portion 14, the needle valve 17 is arranged along the axis of the injector body 1. The needle valve 17 has a large diameter portion 17*a* and a small diameter portion 17*b* formed integral with the large diameter portion 17*a* on its front end side. The large and small diameter portions are both slidably guided in a guide hole 16 formed in the nozzle portion 14 according to the sizes of the large and small diameter portions. Between the small diameter portion 17*b* and the guide hole 16, in particular, there is formed a clearance 18 as a fuel passage. The fuel supplied to the fuel retaining portion 21 also fills the clearance 18. The tapered surface 17*c* formed between the large diameter portion 17*a* and the small diameter portion 17*b* of the needle valve 17 constitutes a part of the wall defining the fuel retaining portion 21 and also provides a pressure receiving surface for receiving the fuel pressure to urge the needle valve 17 toward the lifting direction. The front end of the nozzle portion 14 is formed with nozzle holes 19 that inject the fuel supplied through the clearance 18 into the combustion chamber when the needle valve 17 is lifted. The front end of the small diameter portion 17*b* of the needle valve 17 is separated from or seated on a tapered surface 20 formed at the front end of the nozzle portion 14 to inject from the nozzle holes 19 or block the fuel filled in the clearance 18.

In the control portion 13 is formed a balance chamber 30 enclosed by a wall surface of a hole 29 and a pressure receiving surface (formed partly by the upper surface of a retainer 22) including an end face 31 of an upper end portion 17*d* of the needle valve 17. The high pressure fuel is supplied into the balance chamber 30 through a throttle 32 branching from a supply passage of this invention, i.e., the fuel supply passage 23. In the balance chamber 30 a coil spring 25 is installed compressed between the control portion 13 and the retainer 22 secured to the needle valve 17. The force of the coil spring 25 and the force produced by the fuel pressure in the balance chamber 30 urge the needle valve 17 to close. The control portion 13 is prevented from being shifted in position with respect to the central portion 3 by a pin 28 fitted into a pin hole 26 formed in the central portion 3 and a pin hole 27 formed in the control portion 13, both pin holes being offset from the center.

As shown in FIGS. 2 and 3, the central portion 3 is formed with a discharge passage 33 to release the fuel pressure in the balance chamber 30 into the hollow portion 4 when an open-close valve 5 is open. A valve stem 34 of the open-close valve 5 is inserted into the discharge passage 33 and a valve face 35*a* of a valve head 35 at the front end of the valve stem 34 can be brought into and out of contact with a valve seat 39 formed tapered in the discharge passage 33 on the balance chamber 30 side. The open-close valve 5 is urged in the closing direction by a return spring 38 installed compressed between a spring retainer 36 on the valve stem 34 and an upper surface 37 of the control portion 13.

The solenoid actuator 2 to drive the open-close valve 5 includes two solenoid portions 40, 41 arranged in series, a control rod 46 to transmit the output of the solenoid portions to the open-close valve 5, and a reset spring 50. The solenoid portions 40, 41 have the similar structures though there are some differences in the stroke of the armature, and identical constitutional elements in the solenoid portions are assigned like reference numbers. The solenoid portions 40, 41 each have an annular stationary core 42, a solenoid 43 enclosing the outer side of the stationary core 42, and an armature 44 accommodated inside the stationary core 42 such that when the solenoid 43 is energized, the armature 44 can be urged to reciprocate axially, guided by the stationary core 42. The front end of the armature 44 of the solenoid portion 40 passes through a stopper 44*a* and engages a movable member 45, through which it is drivingly coupled to the armature 44 of the solenoid portion 41. The stopper 44*a* fixedly provided to the stationary core 42 limits the stroke of the armature 44. For example, the stroke of the armature 44 of the solenoid portion 40 is set relatively short while that of the armature 44 of the solenoid portion 41 is set relatively long.

The control rod 46 extends through a through-hole 47 that communicates a hollow recess 49 in the upper part of the central portion 3 with the hollow portion 4. A large diameter portion 48 of the control rod 46 on the solenoid actuator 2 side is fitted airtightly in the hollow recess 49. The reset spring 50 installed in the hollow recess 49 acts on the large diameter portion 48 to urge the control rod 46 toward a non-operated position. With the solenoid portions 40, 41 in the driven state, the armatures 44 engage and drive the control rod 46. The control rod 46 is guided along the hollow portion 4 by guide pieces 51 formed integral with the control rod 46. The control rod 46 is drivingly coupled to the open-close valve 5 to control the valve operation. More specifically, the control rod 46 has its lower end abut against the valve stem 34.

The fuel discharged through the discharge passage 33 flows through the hollow portion 4, the through-hole 47 and a transverse passage 55 crossing the through-hole 47 and then to a leakage passage 56 formed in the bracket 60, from which the fuel is returned through a fuel discharge pipe 57 to the fuel supply side such as a fuel tank. The central portion 3 of the fuel injector is inserted airtightly in a hole 58 in the bracket 60 by using a sealing member. The central portion 3 is secured to the bracket 60 by screwing an outer case 59 of the solenoid actuator 2 over the end portion of the central portion 3 projecting from the hole 58 to clamp the bracket 60 between the shoulder of the central portion 3 and the outer case 59.

When the solenoid portions 40, 41 are not activated, the reset spring 50 urges the control rod 46 toward the uppermost position in FIG. 1, which in turn forces the armatures 44 to the non-operated position, allowing the open-close valve 5 to be closed by the force of the return spring 38, blocking the release of the fuel pressure. The balance chamber 30 is supplied with a high pressure fuel through the throttle 32. In this state the pressure in the balance chamber 30 acts on the pressure receiving surface of the needle valve 17 and the force pushing down the needle valve 17 is large. Thus, the combined force of the fuel pressure-induced force and the force of the coil spring 25 is larger than the lifting force acting on the tapered surface 17*c* which is produced by the fuel pressure in the fuel retaining portion 21. The result is that the needle valve 17 closes the nozzle holes 19 and no fuel injection is performed.

When a control current is supplied to the solenoid portion 40 to energize the solenoid 43, the armature 44 is urged downward toward the operated position in FIG. 1. The downward motion of the armature 44 causes, through the armature 44 of the solenoid portion 41, the control rod 46 to move toward the nozzle front end side against the force of the reset spring 50 and the return spring 38. The control rod 46 thus pushes down the valve stem 34 causing the valve face 35*a* of the valve head 35 to part from the valve seat 39, opening the discharge passage 33, with the result that the high pressure fuel in the balance chamber 30 is released through the discharge passage 33 into the hollow portion 4 as shown by the arrows in FIG. 3. Because the cross-sectional area of the throttle 32 is set sufficiently smaller than the cross-sectional area of the discharge passage 33, the high pressure fuel is not replenished immediately from the fuel supply passage 23 and the fuel pressure in the balance chamber 30 lowers. In this state the combined force of the force of the coil spring 25 and the force provided by the reduced fuel pressure in the balance chamber 30 becomes smaller than the lifting force acting on the tapered surface 17*c* of the needle valve 17 which is produced by the fuel filled in the clearance 18 between the small diameter portion 17*b* of the needle valve and the guide hole 16. Hence, the fuel is ejected from the nozzle holes 19.

When the engine load is higher than an intermediate level, the solenoid portion 41 is driven for an entire injection period of the fuel injection cycle or for the second stage of the fuel injection cycle already under way. In this case, a large control current is supplied to the solenoid 43 to increase the speed and stroke of the open-close valve 5, which in turn increases the speed and stroke of the needle valve 17, increasing the fuel injection rate.

Figure 6:
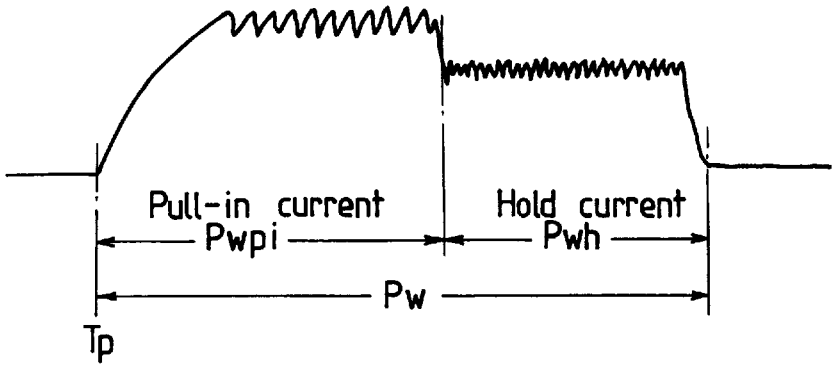
FIG. 6 is a graph showing a waveform of a drive current for the solenoid in the fuel injection control device.

The solenoid actuator 2 is supplied with a control current from a controller 70. The controller 70 determines the magnitude of the control current according to the load, such as engine revolution Ne and the amount of depression of an accelerator pedal Acc, and supplies the control current in the form of, for example, command pulses to one or both of the solenoid portions 40, 41. The control current has a waveform as shown in FIG. 6. That is, in a drive current application inception period, i.e., an initial pull-in current conduction period Pwpi beginning with the command pulse start timing Tp, a large current as the pull-in current is supplied to the solenoid portions 40, 41 to generate in the armatures 44 a force large enough to push in the valve stem 34 of the open-close valve 5 against the fuel pressure in the balance chamber 30. Once the open-close valve 5 is opened, the force required to keep the valve open is very small and a relatively small current as the hold current is supplied to the solenoid portions 40, 41. The time from the command pulse start timing Tp to the end of a hold current conduction period Pwh is a total conduction period (command pulse width) Pw.

Figure 4:
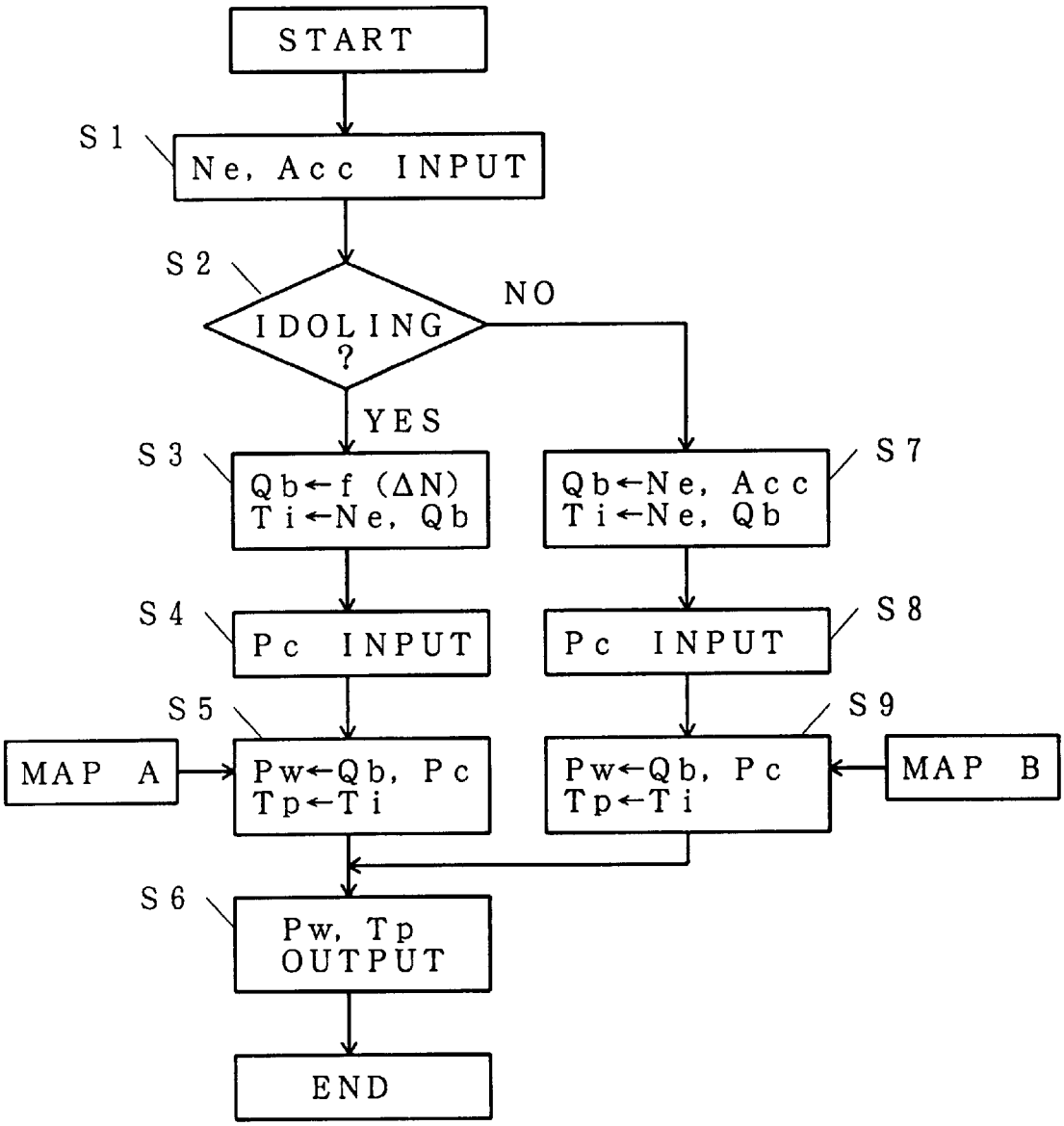
FIG. 4 is a process flow showing one embodiment of a sequence of operations performed by the fuel injection control device of this invention.
Figure 5:
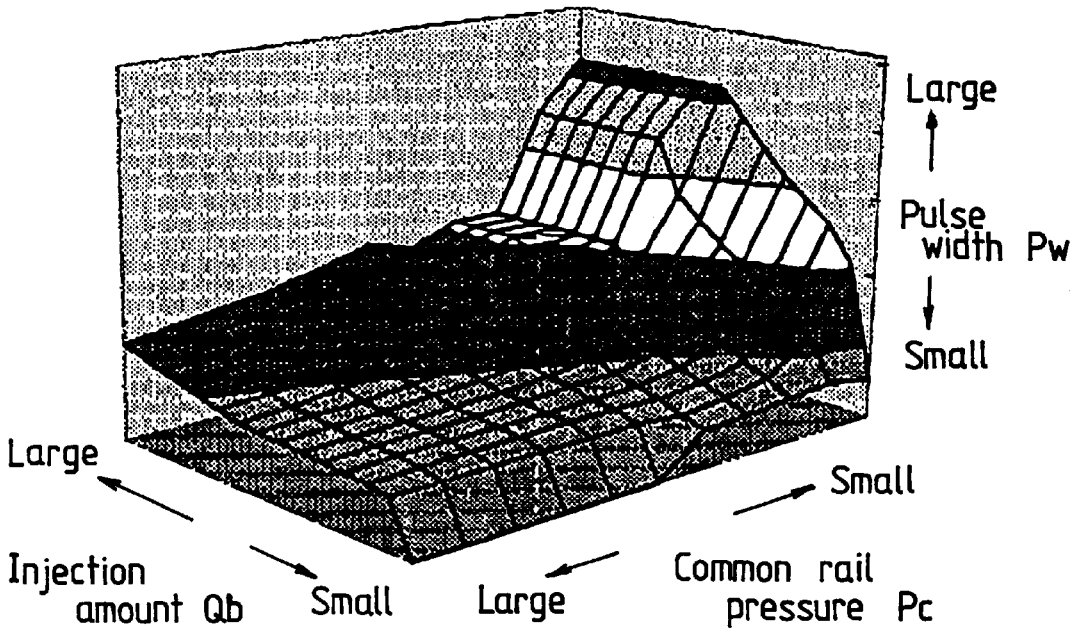
FIG. 5 is a graph showing one embodiment of a conversion map representing the relation between the amount of injection, a common rail pressure and a pulse width in the control of FIG. 4 performed by the fuel injection control device.

FIG. 4 is a flow chart showing an example sequence of control performed by this fuel injection control device. FIG. 5 is a graph showing a map to determine the command pulse width at step S9 in the flow chart of FIG. 4. The control flow of this fuel injection control device will be explained in connection with the flow chart of FIG. 4.

When this flow is initiated, the engine revolution Ne and the amount of accelerator depression Acc are input from sensors (step S1).

The controller 70 decides whether the engine is idling or not (step S2). When, for example, the sensors are an engine revolution sensor and an accelerator depression amount sensor and when the engine revolution Ne is below a preset revolution Ni and the accelerator pedal depression amount Acc is 0%, it is decided that the engine is idling. Alternatively, with the sensors formed as an engine revolution sensor and an idle switch that turns on when the accelerator pedal is depressed, when the engine revolution Ne is less than a predetermined idling reference revolution Ni and the idle switch is on, the engine may be determined to be idling.

At step S2 if the controller 70 decides that the engine is idling, $\Delta N = Ni - Ne$ is calculated based on the engine revolution Ne and the amount of accelerator pedal depression Acc, both input at step S1. Then a target injection amount Qb to feedback-control the engine revolution with the idling reference revolution Ni as a target is calculated as a function of $\Delta N$, $f(\Delta N)$. This function $f(\Delta N)$ may include, for example, a function which has a dead zone $f(\Delta N)=0$ near $\Delta N=0$ (no feedback control is performed if the error falls within a predetermined range) and has polygonal lines with negative gradients for feedback control. Further, based on the engine revolution Ne and the target injection amount Qb, a target injection timing Ti at which to inject the fuel from the nozzle holes is determined from the map (step S3).

The actual fuel pressure in the common rail, i.e., a common rail pressure Pc, is detected by a pressure sensor (step S4).

According to the predetermined map A, a command pulse width Pw for the solenoid actuator is determined using the target injection amount Qb and the common rail pressure Pc. Also, a command pulse start timing Tp for the solenoid actuator which occurs slightly before the corresponding target injection timing Ti is calculated (step S5). When compared with a map B shown in FIG. 5, the map A sets the command pulse width Pw wide in an area where the common rail pressure Pc is low and the injection amount is small. During idling, the initial pull-in current conduction period (pulse width) Pwpi in the command pulse width Pw is reduced to effect a relatively slow displacement of the armature 44 and the total current conduction period, i.e., command pulse width Pw, is set sufficiently long.

The control current with the above settings of the command pulse width Pw and the command pulse start timing Tp is output to the solenoid actuator (step S6). Upon reception of the control current, the solenoid actuator opens the open-close valve 5 to release the fuel pressure in the balance chamber 30 and lift the needle valve 17 to eject fuel from the nozzle holes 19 under conditions that match the idling state.

If at step S2 the controller 70 decides that the engine is not idling, the target injection amount Qb is determined based on the predetermined map using the engine revolution Ne and the accelerator depression amount Acc, both input at step S1. Further, from the engine revolution Ne and the target injection amount Qb, the target injection timing Ti at which to inject fuel is determined according to the map (step S7). That is, because the relation between the engine revolution Ne and the target injection amount Qb as the basic characteristics of the engine is already known with the accelerator depression amount Acc as a parameter, the target fuel injection amount Qb to be injected in each combustion cycle can be determined from the engine revolution Ne and the accelerator pedal depression amount Acc at each instant according to the basic injection amount characteristic map, and also the optimum injection timing is determined from the engine revolution Ne and the target injection amount Qb.

The actual common rail pressure Pc is detected by a pressure sensor (step S8).

The command pulse width Pw to be supplied to the solenoid actuator 2 is calculated according to the predetermined map B of FIG. 5 using the target injection amount Qb and the common rail pressure Pc. And then the command pulse start timing Tp for the solenoid actuator 2 which slightly precedes the target injection timing Ti is determined (step S9). Because the engine is running at high load and revolution, the initial pull-in current conduction period Pwpi in the command pulse width Pw is set long to enable a relatively quick displacement of the armature 44 against high fuel pressure in the balance chamber and the total current conduction period, i.e., the command pulse width Pw, is set short.

The control current with the above settings of the command pulse width Pw and the command pulse start timing Tp is output to the solenoid actuator (step S6).

Figure 7:
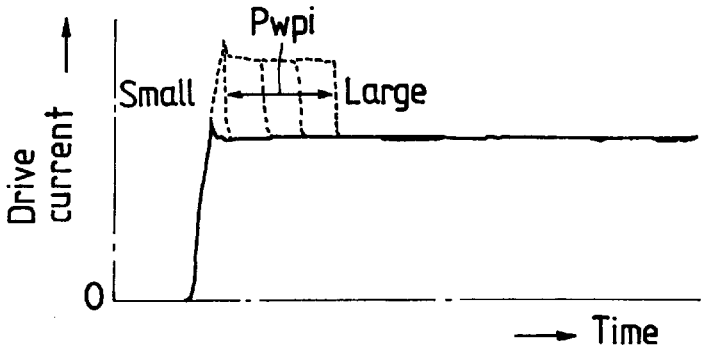
FIG. 7 is a graph showing a waveform of the drive current for the solenoid with the pull-in current duration changed.
Figure 8:
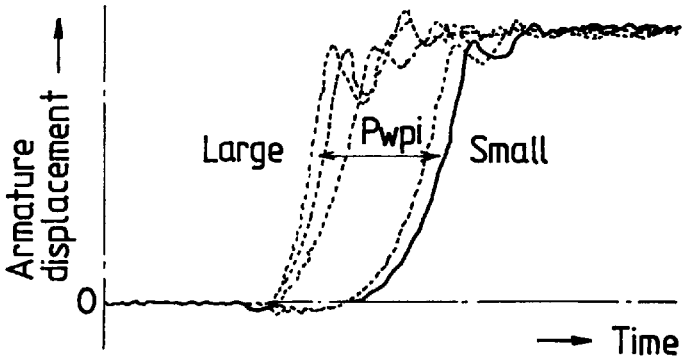
FIG. 8 is a graph showing the displacement of an armature of the solenoid in response to the drive current for the solenoid shown in FIG. 7.

FIG. 7 is a graph showing one example of a command pulse current waveform as a solenoid excitation current, with the pull-in current conduction period Pwpi, which has a large impressed current value at the start, varied. FIG. 8 is a graph showing how the armature displacement in the solenoid portion changes when the pull-in current conduction period Pwpi of the drive current is varied as shown in FIG. 7. The wider the pull-in current conduction period Pwpi output at the initial part of the command pulse current, the quicker the displacement of the armature of the solenoid as shown in FIG. 8. The narrower the pull-in current conduction period Pwpi, the more slowly the armature in the solenoid portion is displaced. The same armature action as described above takes place in the solenoid actuator 2 of the fuel injector. Hence when the fuel pressure in the balance chamber is low as during a low load operation, the pull-in current conduction period Pwpi of the excitation current to be supplied to the solenoid in the solenoid portion of the solenoid actuator 2 can be set narrow to slow down the initial armature displacement speed to reduce injector noise produced in the solenoid portion.

What is claimed is:

1. A fuel injection control device comprising:

bodies having nozzle holes for injecting fuel into combustion chambers in an engine;

needle valves reciprocating in hollow portions in the bodies to open and close the nozzle holes;

balance chambers supplied a part of injection fuel to control the lift of the needle valves, an end of the needle valves forming fuel pressure receiving surfaces in the balance chambers;

supply passages to supply a fuel pressure to the balance chambers;

discharge passages to release the fuel pressure in the balance chambers;

open-close valves to open and close the discharge passages;

solenoid actuators to drive the open-close valves;

sensors to detect the operating condition of the engine; and a controller to control drive current supply to the solenoid actuators according to the operating condition detected by the sensors;

wherein the controller sets a pull-in current conduction period of the drive current supplied to the solenoid actuators when the operating condition detected by the sensors is a low load operation, to a value shorter than a pull-in current conduction period of the drive current supplied to the solenoid actuators when the operating condition detected by the sensors is a high load operation.

2. A fuel injection control device according to claim 1, wherein the low load operation is an operation in which the engine is idling.

3. A fuel injection control device according to claim 1, wherein the controller sets a conduction start timing of the drive current for the low load operation, at a point earlier than a conduction start timing of the drive current for the high load operation, and sets a total conduction period of the drive current for the low load operation longer than a total conduction period of the drive current for the high load operation.

4. A fuel injection control device according to claim 1, wherein the solenoid actuators comprise solenoids, armatures driven by energization of the solenoids, control rods drivingly coupled to the armatures and adapted to occupy an operated position to open the open-close valves when the solenoids are energized, and resetting means to reset the control rods to a non-operated position to close the open-close valves when the solenoids are deenergized.

5. A fuel injection control device according to claim 4, wherein the open-close valves comprise valve stems extending into the discharge passages and drivingly coupled to the control rods, valve heads provided at the front end of the valve stems and having valve faces that can be seated on valve seats formed in openings of the discharge passages on the balance chamber side, and return springs urging the valve faces to be seated on the valve seats.

6. A fuel injection control device according to claim 1, wherein the injection fuel is supplied through a common rail that stores the fuel supplied by a fuel pump, and the controller sets the fuel pressure in the common rail during the low load operation lower than the fuel pressure in the common rail during the high load operation.

* * * * *